United States Patent [19]

Tutschek et al.

[11] 4,218,970

[45] Aug. 26, 1980

[54] COMPRESSION ROLLERS FOR DEHYDRATION EQUIPMENT

[75] Inventors: Ernst Tutschek; Johann Sbaschnigg, both of Graz, Austria

[73] Assignee: Maschinenfabrik Andritz Actiengesellschaft, Austria

[21] Appl. No.: 878,887

[22] Filed: Feb. 17, 1978

[51] Int. Cl.[2] ..... B30B 3/02

[52] U.S. Cl. ..... 100/153; 100/154; 100/162 B

[58] Field of Search ..... 100/153, 154, 176, 162 B, 100/160, 172, 121, 118, 151; 144/281 B; 198/842, 826; 193/35 R

[56] References Cited

U.S. PATENT DOCUMENTS

| | | | |
|---|---|---|---|
| 1,516,666 | 11/1924 | Briggs | 198/826 |
| 2,818,966 | 1/1958 | Gill | 198/826 |
| 3,792,656 | 2/1974 | Heissenberger | 100/118 |
| 3,795,470 | 3/1974 | DeMets | 100/151 X |
| 3,965,769 | 6/1976 | Ahrweiler et al. | 144/281 B |

*Primary Examiner*—Henry C. Yuen
*Assistant Examiner*—Harold Joyce
*Attorney, Agent, or Firm*—James E. Bryan

[57] ABSTRACT

This invention relates to an improvement in dehydrating equipment, in particular double belt presses, in which an upper endless sieve belt is guided by means of parallelly supported rollers, with parallelly supported rollers being similarly arranged below and on which a lower endless sieve belt is guided, the suspension to be dehydrated being introduced between the sieve belts, the sets of rollers being divided into a wedge section, a registering section, a precompression section and a main compression section, the improvement comprising that the compression rollers in the pre-compression section are composed of several pieces extending across the equipment and, when viewed in the direction of motion of the sieve belts, are alternatingly offset backwardly or forwardly, the ends of the rollers penetrating the region of adjacent rollers in overlapping fashion.

1 Claim, 3 Drawing Figures

COMPRESSION ROLLERS FOR DEHYDRATION EQUIPMENT

This invention relates to compression rollers for dehydration equipment, in particular double-belt presses, on which is guided an upper endless sieve-belt or wire-cloth on parallelly arranged rollers, a similar set of rollers being located underneath on which, in turn, runs a lower endless wire cloth, the suspension to be dehydrated being introduced into the space between the wire-cloths, and the groups of rollers being divided into wedging, registering, pre-pressing and main-compressing roller sections.

Compression rollers are used to feed the material already partially pre-dehydrated in the individual roller sections of the dehydration equipment of the invention to a main dehydration stage. As already mentioned, such machinery is known as double belt presses. Similar equipment is shown in Austrian Pat. No. 313,044. This equipment also comprises a set of rollers divided into wedging, registering, pre-pressing and main pressing sections.

While such equipment affords very high efficiency and is indeed very compact, increasing its output generally is implemented by enlarging the belt width so as to feed a correspondingly larger amount into the machine at the intake. This enlarging method, simple per se, has limitations however because such equipment cannot be made arbitrarily large. This limitation is set not only by spatial size, but above all by the mechanical strength of the individual compression rollers. As long as the suspension holds appreciable humidity and the compression is not required to be high, rollers of relatively small diameters will suffice. The areal compression is gradually increased by the wedge arrangement of the rollers until the suspension comes to the end of the wet and registering sections. In view of the progressive dehydration from one pair of rollers to the next in the following pre-compression section, the compression so increases that already serious problems relating to the mechanical strength of these compression rollers may occur. This requires selecting an already somewhat larger roller diameter than for the previous roller at the registering section in order to withstand the compressive stresses. What this means most of all is that for relatively wide rollers, they may so flex that the desired compression no longer can be maintained, at least in the central region of the wire cloth. Conceivably such compression rollers might be additionally supported by other supporting rollers above or below them or by similar means. Such a step however may be undesirable because of the greater bulk of the machine, and significantly, these support rollers also might damage the compression rollers with adverse scoring or grooving for the wire cloth. The biggest drawback furthermore is that the specific compression depends upon the roller diameter and can be increased only by decreasing this diameter. But a decrease in diameter again is impossible on ground of mechanical strength because the rollers will flex above a given compression limit and therefore will no longer achieve the desired dehydration effect.

The invention addresses the task of creating compression rollers for dehydration equipment, in particular for double belt presses of the previously cited type, which permit significant widening of the equipment without thereby causing roller flexure and preventing a loss in compression at least in the central region of the wire cloth. This object is achieved by the invention by designing the compression rollers in the pre-compression section in multi-pieces across the width of the equipment and by alternatingly mounting them in an offset manner forward and backward in the direction of motion of the wire cloth, the roller ends projecting into the region of the next one in an overlapping manner.

This design of the compression rollers permits so extending the machine width that its output can be significantly increased. This offers the advantage that the same compression also is applied practically at the center of the wire cloth to the suspension and that flexure of the rollers no longer is possible. Furthermore it is less expensive to make individual rollers and storage of spare parts thus causes no difficulties.

The invention will be further illustrated by reference to the accompanying drawings, in which.

Figure 1:
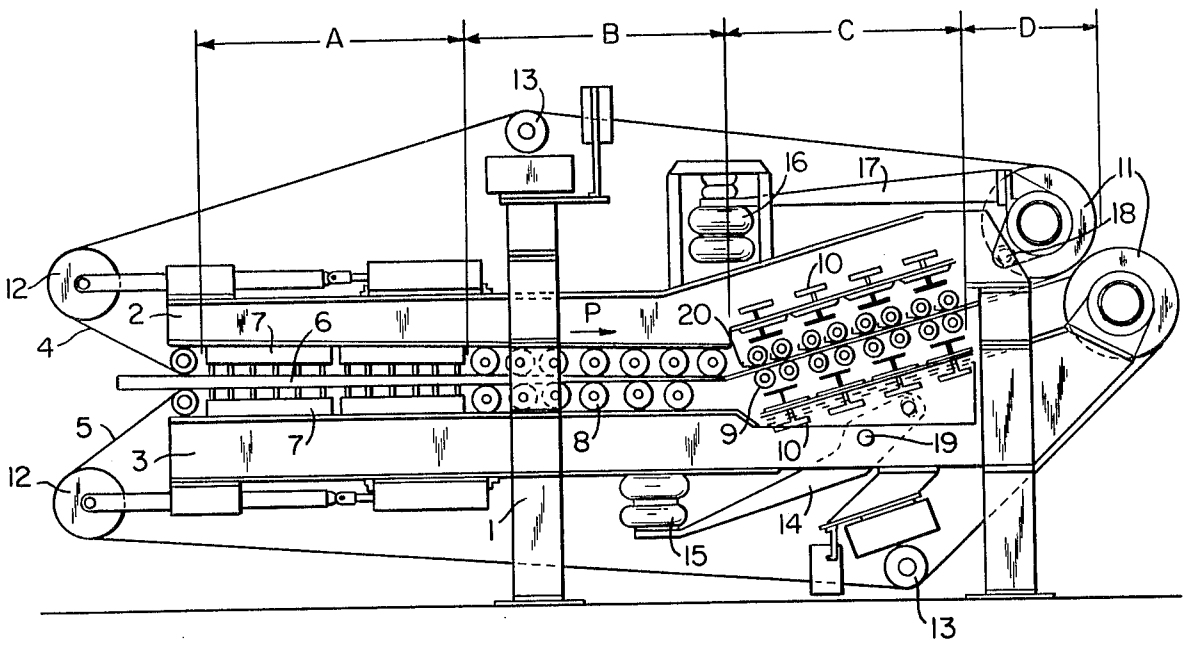
FIG. 1 is an elevation of a double belt press.

FIG. 1 is a side view of a dehydrating machine. The equipment support is composed of a structure 1, plus a frame mounted transversely to the longitudinal machine axis and somewhat in the shape of gallows and to which are mounted the upper girder 2 in a lengthwise manner and the lower girder 3. The individual rollers 8, 9, and 11 are mounted to these two girders 2 and 3. An upper wire cloth 4 is guided around the upper rollers and in similar manner a lower wire cloth 5 around the lower ones. The machine is divided into individual sections, the wet part or wedging section A at the equipment intake subjecting the suspension to pre-dehydration and preferably comprising the suction boxes 7 in lieu of rollers. After the wedging section A, the cake 6 of material so created is fed to the registering section B composed of a number of pairs of rollers with gradually decreasing vertical axial separation. The predehydrated material is further squeezed in this registering section and fed to the next roller section denoted as a pre-compression section C, which preferably is of ascending design. The roller arrangements of the invention are located in this pre-compression section C; they will be discussed comprehensively below. Lastly, the main compression section D is mounted at the end of the equipment; it exerts high pressure on the material to be dehydrated and removes any residual moisture from the cake of material.

As already mentioned, the wedging section A is composed of individual suction boxes 7 taking in moisture through the wire cloths 4 and 5 and exhausting it through proper mains. The registering rollers 8 are mounted in the registering section B, the vertical separation between the roller axes decreasing from one pair of rollers to the next, whereby the material to be dehydrated assumes the shape of a wedge. Sturdy, double T-shaped supports 10 are mounted in the girders 2 and 3 in the pre-compression section C and extend across the entire width of the equipment. Again, an arrangement of upper and lower rollers being the case, one such support 10 must be fixed in each girder 2 and 3. Viewed in the direction of the wire cloths, the bearing rollers 21 are mounted in the support 10 and provide bearings for the compression rollers 9. The compression rollers 9 no longer are composed of rollers which are continuous from side to side, rather they are composed of several pieces which, in order to eliminate pleats in the wire cloth, are made forwardly and backwardly offset with respect to each other, i.e. in an overlapping manner.

The diameters of the compression rollers 9 are less than those of the rollers 8 of the registering section B in order to increase the specific compression.

The main compressing section D now is composed of an essentially larger pair of rollers 11 which, however, need not be further discussed. Using a lever 17, the upper roller of the main compression rollers 11 is so moved with respect to a point of rotation 18 by means of a pressure-bellows 16 that the compression may be adjusted as needed. Also, a similar eccentric lever 14 with an axis of rotation 19 is mounted to the lower side of the pre-compression section C, which in turn can vary the compression acting on the lower part of the compression rollers 9. The wire cloths 4 and 5 are designed as endless belts and pass over the rollers mounted in the individual sections. The tensioning rollers 12 and guide rollers 13 are further provided for tensioning the wire cloths. The arrow P indicates the direction of motion of the wire cloth.

Figure 2:
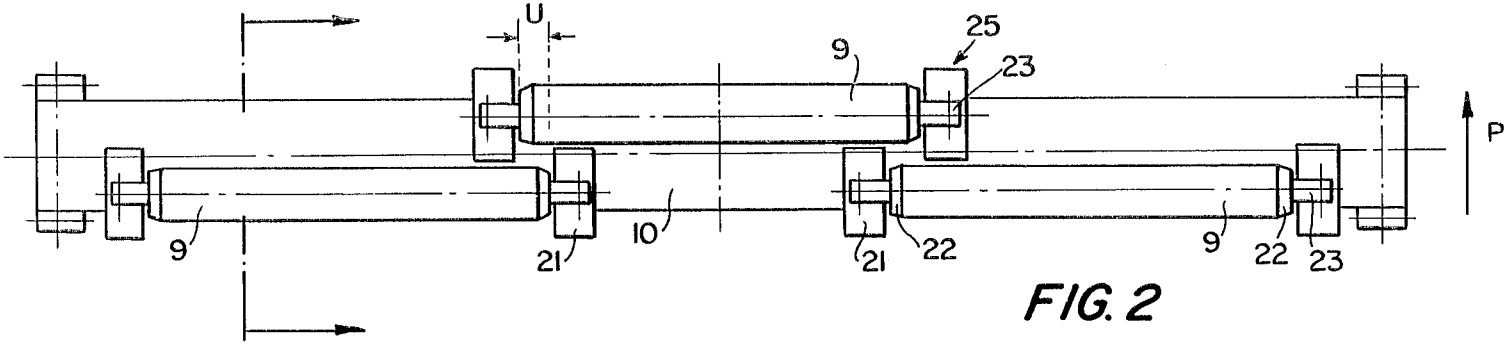
FIG. 2 is a top view of the rollers.

FIG. 2 is a top view showing the arrangement of the compression rollers 9. They are mounted on the support 10 extending across the entire width of the equipment. The Figure illustratively shows only three compression rollers 9, but quite conceivably their number may be increased depending on their length and on the width of the particular machine. The compression rollers 9 are so mounted by means of the bearing rollers 21 on the support 10 that when viewed in the direction of motion of the wire cloth (arrow P), one will be offset backwardly, or the other forwardly. It should be borne in mind in this regard that one end of a roller does not begin immediately where the other ceases, but rather that there is a given overlap U of the two ends. This overlap U corresponds to the length of a roller radius. This ensures there will be no unevenness in dehydration at the impact points of the rollers. The ends 25 furthermore are provided with a bevel 22 designed as a convex surface. Beyond this bevel there are the bearing pins 23, in conventional manner, which in turn rest in the bearings 21.

Figure 3:
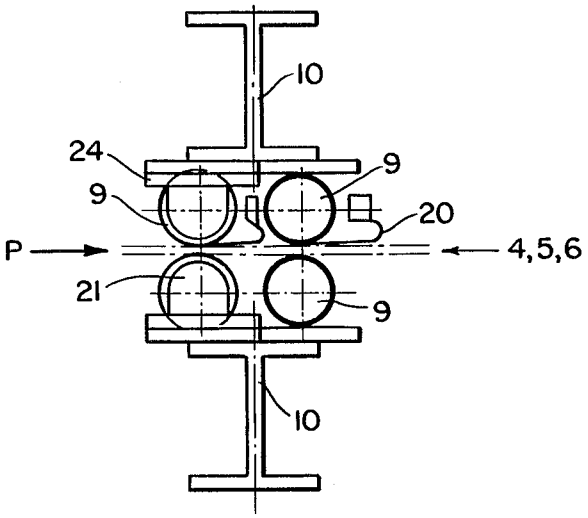
FIG. 3 is a view of the compression rollers bearing.

FIG. 3 shows a section corresponding to the arrows of the compression roller arrangement shown in FIG. 2. The design and the arrangement of the two T-shaped supports 10 are readily apparent, the support bearings 21 joining the chords facing them. Any assembly inaccuracies may be compensated for using the leveling pieces 24. Naturally, the supports 10 are so fixed in the girder that fine adjustment of the spacing between the roller pairs may be achieved. Here again the arrow P indicates the direction of motion of the wire cloth. The transverse drains 20 advantageously are provided to drain water in order to eliminate reabsorption of the moisture.

This design of the compression rollers 9, which no longer are one integral piece but rather are multi-piece, achieves the feasibility of decreasing the diameter of the compression rollers 9, for the purpose of increasing the specific compression, in a manner such that no flexure occurs. If, for example, the rollers were of one integral piece, there inevitably would be higher dehydration in the vicinity of the bearing locations and inadequate dehydration at the center of the wire cloth path. This cannot happen in the compression rollers of the invention because proper sizing prevents flexure of the support 10 and the relatively short compression rollers 9 can withstand the load without deformation. It follows from this design that it is possible to make dehydration equipment of greater widths and that, furthermore, the specific compression applied to the material to be dehydrated also can be further increased. In this manner it is possible in a simple fashion to further improve the equipment efficiency.

It will be obvious to those skilled in the art that many modifications may be made within the scope of the present invention without departing from the spirit thereof, and the invention includes all such modifications.

What is claimed is:

1. In dehydrating equipment, in particular double belt presses, in which an upper endless sieve belt is guided by means of parallelly supported rollers, with parallelly supported rollers being similarly arranged below and on which a lower endless sieve belt is guided, the suspension to be dehydrated being introduced between the sieve belts, the sets of rollers being divided into a wedge section, a registering section, a pre-compression section and a main compression section, the improvement comprising that the compression rollers in the pre-compression section are composed of several pieces extending across the equipment and, when viewed in the direction of motion of the sieve belts, are alternatingly offset backwardly or forwardly, the ends of the rollers penetrating the region of adjacent rollers in overlapping fashion, and bearings for each roller resting on a common support extending through the equipment from end to end.

* * * * *